US008888216B2

(12) United States Patent
Ito

(10) Patent No.: US 8,888,216 B2
(45) Date of Patent: Nov. 18, 2014

(54) LIQUID EJECTION APPARATUS INCLUDING CONTROLLER SUPPLYING NON-EJECTION DRIVE SIGNAL

(75) Inventor: Yuichi Ito, Mie-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 332 days.

(21) Appl. No.: 13/431,785

(22) Filed: Mar. 27, 2012

(65) Prior Publication Data

US 2012/0327148 A1 Dec. 27, 2012

(30) Foreign Application Priority Data

Jun. 24, 2011 (JP) ..... 2011-141017

(51) Int. Cl.
*B41J 29/38* (2006.01)
*B41J 2/045* (2006.01)

(52) U.S. Cl.
CPC ..... *B41J 29/38* (2013.01); *B41J 2/04553* (2013.01); *B41J 2/04566* (2013.01); *B41J 2/04595* (2013.01); *B41J 2/04596* (2013.01); *B41J 2/04581* (2013.01); *B41J 2/04588* (2013.01); *B41J 2/0451* (2013.01)
USPC ..... 347/10

(58) Field of Classification Search
None
See application file for complete search history.

(56) References Cited

U.S. PATENT DOCUMENTS

| | | | | |
|---|---|---|---|---|
| 6,357,846 | B1 * | 3/2002 | Kitahara | 347/10 |
| 6,386,664 | B1 * | 5/2002 | Hosono et al. | 347/9 |
| 6,820,955 | B1 * | 11/2004 | Usui | 347/7 |
| 2010/0201730 | A1 | 8/2010 | Satake | |
| 2010/0245919 | A1 * | 9/2010 | Kanzaki | 358/1.17 |

FOREIGN PATENT DOCUMENTS

| | | | |
|---|---|---|---|
| JP | 2001-260369 | A | 9/2001 |
| JP | 2006-297666 | A | 11/2006 |
| JP | 2010-184363 | A | 8/2010 |
| JP | 2011194764 | A * | 10/2011 |

* cited by examiner

*Primary Examiner* — Geoffrey Mruk
*Assistant Examiner* — Bradley Thies
(74) *Attorney, Agent, or Firm* — Baker Botts L.L.P.

(57) ABSTRACT

The liquid ejection apparatus includes a liquid ejection head, a drive unit, a non-ejection drive controller, and an environment measurement unit. The drive unit selectively supplies an ejection drive signal and a non-ejection drive signal to the actuator. The non-ejection drive controller causes the drive unit to supply the non-ejection drive signal to the actuator within a non-ejection drive period which is at the trailing end portion of the non-ejection period, when the non-ejection period satisfies the predetermined condition. The non-ejection drive controller controls the drive unit so that the length of a blank period is varied based on at least one of the temperature and the humidity measured by the environment measurement unit, the blank period being a period between a point of supplying a final non-ejection drive signal within the non-ejection drive period and the trailing end of the non-ejection period.

9 Claims, 10 Drawing Sheets

LIQUID EJECTION APPARATUS INCLUDING CONTROLLER SUPPLYING NON-EJECTION DRIVE SIGNAL

CROSS REFERENCE TO RELATED APPLICATION

The present application claims priority from Japanese Patent Application No. 2011-141017, which was filed on Jun. 24, 2011 the disclosure of which is herein incorporated by reference in its entirety.

BACKGROUND OF THE INVENTION

1. Field of the Invention

The present invention relates to a liquid ejection apparatus including a liquid ejection head in which passages for supplying a liquid to ejection openings are formed.

2. Description of the Related Art

In a liquid ejection head having ejection openings which eject a liquid such as ink, ejection characteristics of liquid from the ejection openings may change due to, for example, evaporation of the liquid from the ejection openings. When the ejection characteristics change, there will be a negative influence to image recording by the liquid ejection head. To address this issue, there has been the following technology. Namely, a micro oscillation signal is supplied to the head before supplying of an ejection drive signal for causing ejection of a liquid from an ejection opening. The micro oscillation signal drives the heads to an extent that the liquid is not ejected from the ejection opening, thereby vibrating the liquid nearby the ejection opening. This restrains a change in the ejection characteristics caused by an increase in the viscosity of ink, which leads to prevention of deterioration in an image recorded immediately after the start of recording.

SUMMARY OF THE INVENTION

The above existing-technology however requires an appropriate adjustment of the length of a period between driving of the head by the micro oscillation signal and supplying of a subsequent ejection drive signal. If the period is not appropriately adjusted, the driving of the head by the micro oscillation signal may cause a negative influence to recording operation by an ejection drive signal supplied.

It is therefore an object of the present invention to provide a liquid ejection apparatus in which driving of a head to an extent that no liquid is ejected is suitably kept from negatively influencing driving of the head to cause ejection of the liquid.

A liquid ejection apparatus, including: a liquid ejection head, a drive unit, a print controller, a non-ejection drive controller, and an environment measurement unit. The liquid ejection head includes an ejection opening which ejects a liquid, a supply passage which supplies the liquid to the ejection opening, and an actuator which applies an energy to the liquid inside the supply passage. The drive unit selectively supplies an ejection drive signal and a non-ejection drive signal to the actuator, the ejection drive signal being a signal whereby the actuator is driven so as to eject the liquid from the ejection opening, the non-ejection drive signal being a signal whereby the actuator is driven to an extent that no liquid is ejected from the ejection opening. The print controller causes the drive unit to supply the ejection drive signal to the actuator based on image data. The non-ejection drive controller causes the drive unit to supply at least one non-ejection drive signal to the actuator within a non-ejection drive period which is a period at a trailing end portion of a non-ejection period between ejection of the liquid and the next ejection of the liquid from the ejection opening, when the non-ejection period is equal to or longer than a predetermined length, based on the image data. The environment measurement unit measures at least one of the temperature and the humidity. The non-ejection drive controller controls the drive unit so that the length of a blank period is varied based on at least one of the temperature and the humidity measured by the environment measurement unit, the blank period being a period between a point of supplying a final non-ejection drive signal within the non-ejection drive period and the trailing end of the non-ejection period.

DESCRIPTION OF THE PREFERRED EMBODIMENTS

The following describes with reference to attached drawings a preferable embodiment of the present invention.

Figure 1:
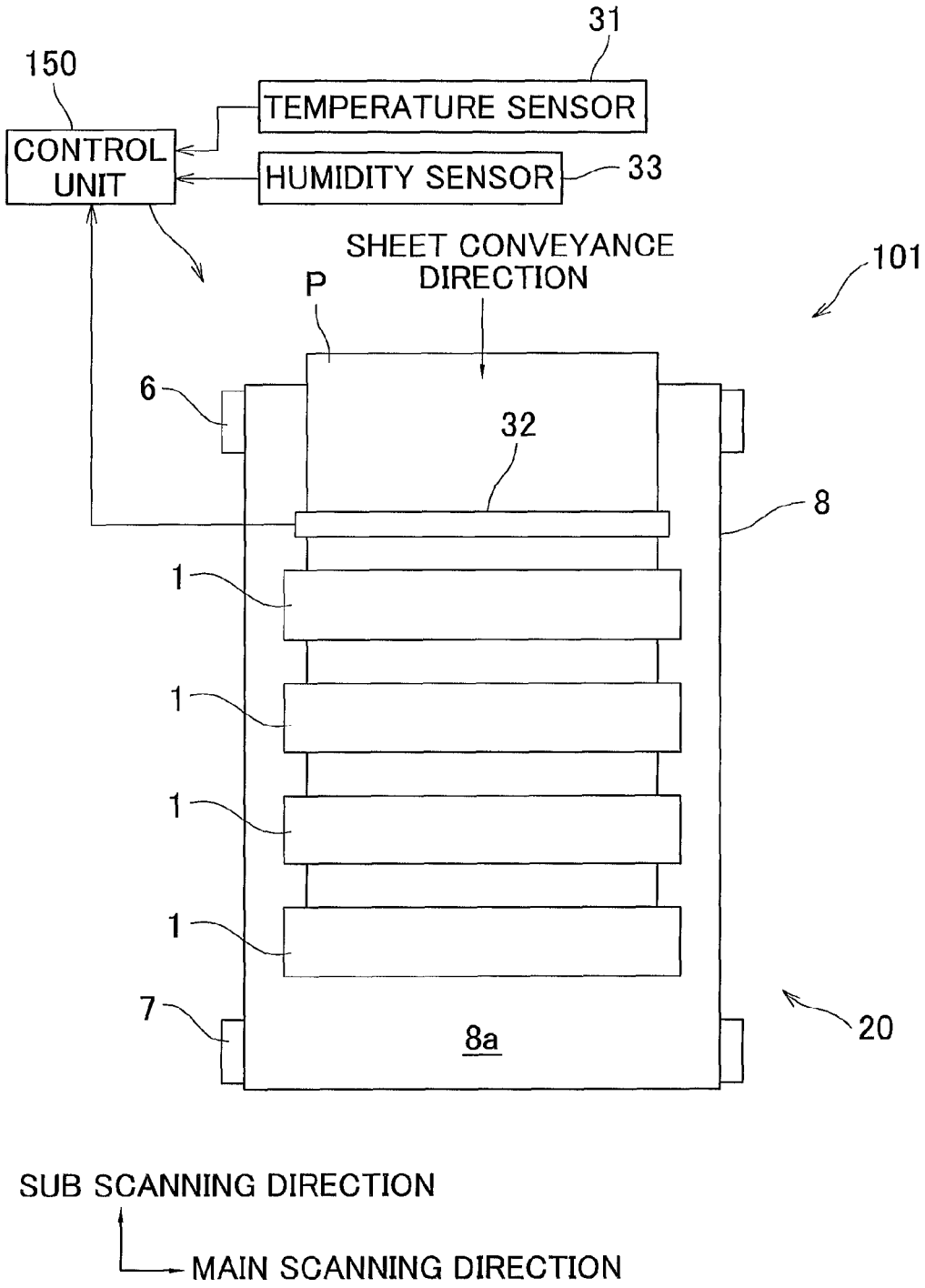
FIG. 1 is a schematic plan view of an ink jet printer related to one embodiment of the present invention.

As shown in FIG. 1, an ink-jet printer 101 includes four ink-jet heads 1, a conveyance unit 20, and a control unit 150. Further, the printer 101 includes a paper feeding unit structured to supply a sheet P for image formation, a sheet output unit which accommodates sheet P having undergone image formation, and a conveyor along a conveyance path which extends from the paper feeding unit to the sheet output unit via a conveyance unit 20. The conveyance unit 20 conveys a sheet P under the heads 1, and the heads 1 eject ink to the sheet P based on image data. The sheet P on which an image is formed is then output to the sheet output unit. The control unit 150 controls an operation of each part of the printer 101 thus administrating operations of the entire printer 101, including aforementioned printing operation. In the printer 101 are provided a temperature sensor 31 and a humidity sensor 33, and the control unit 150 changes control conditions based on an output from each sensor.

The following describes each part of the printer 101. The conveyance unit 20 is described first, followed by the heads 1, and then the structure of the control unit 150 and a control method of each part are described.

As shown in FIG. 1, the conveyance unit 20 has two belt rollers 6 and 7, and an endless conveyor belt 8 looped around the both rollers 6 and 7. The belt roller 7 is a drive roller and rotates with a drive force given by a conveyance motor. Rotation of the belt roller 7 runs the conveyor belt 8. The belt roller 6 is a driven roller which rotates as the conveyor belt 8 runs. A sheet P placed on the surface 8*a* of the conveyor belt 8 is conveyed from the upper side to the downside of FIG. 1. The conveyance unit 20 is provided with a sheet sensor 32. The sheet sensor 32 is disposed upstream of the heads 1 relative to a conveyance direction, and is structured to detect a sheet P passing by. The detection result is sent to the control unit 150 as a sheet leading end signal. Note that in the present embodiment, a sub scanning direction is a direction parallel to the conveyance direction of the sheet P by the conveyance unit 20. The main scanning direction is a direction orthogonal to the sub scanning direction and is a direction along a horizontal plane.

The heads 1 are line heads which are long in the main scanning direction, and eject to a sheet P ink droplets of Black, Magenta, Cyan, and Yellow, respectively. Each of the heads 1 has a head main body 1*a* (see FIG. 2). The under surface of the head main body 1*a* is an ejection face is having thereon a plurality of ejection openings 108 (see FIG. 4). Further, these heads 1 are disposed parallel to and next to each other in the sub scanning direction.

Figure 2:
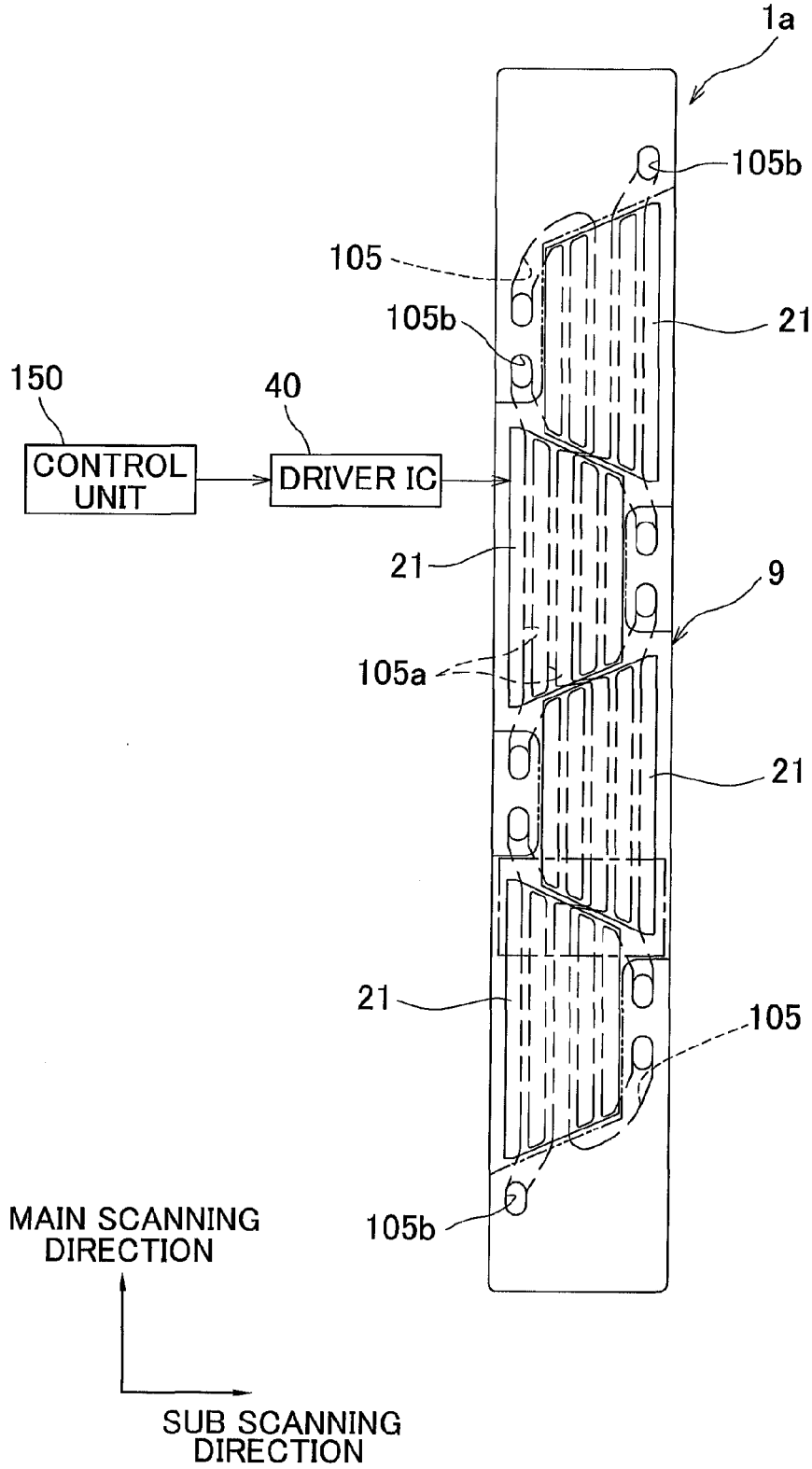
FIG. 2 is a plan view of the head main body shown in FIG. 1.
Figure 3:
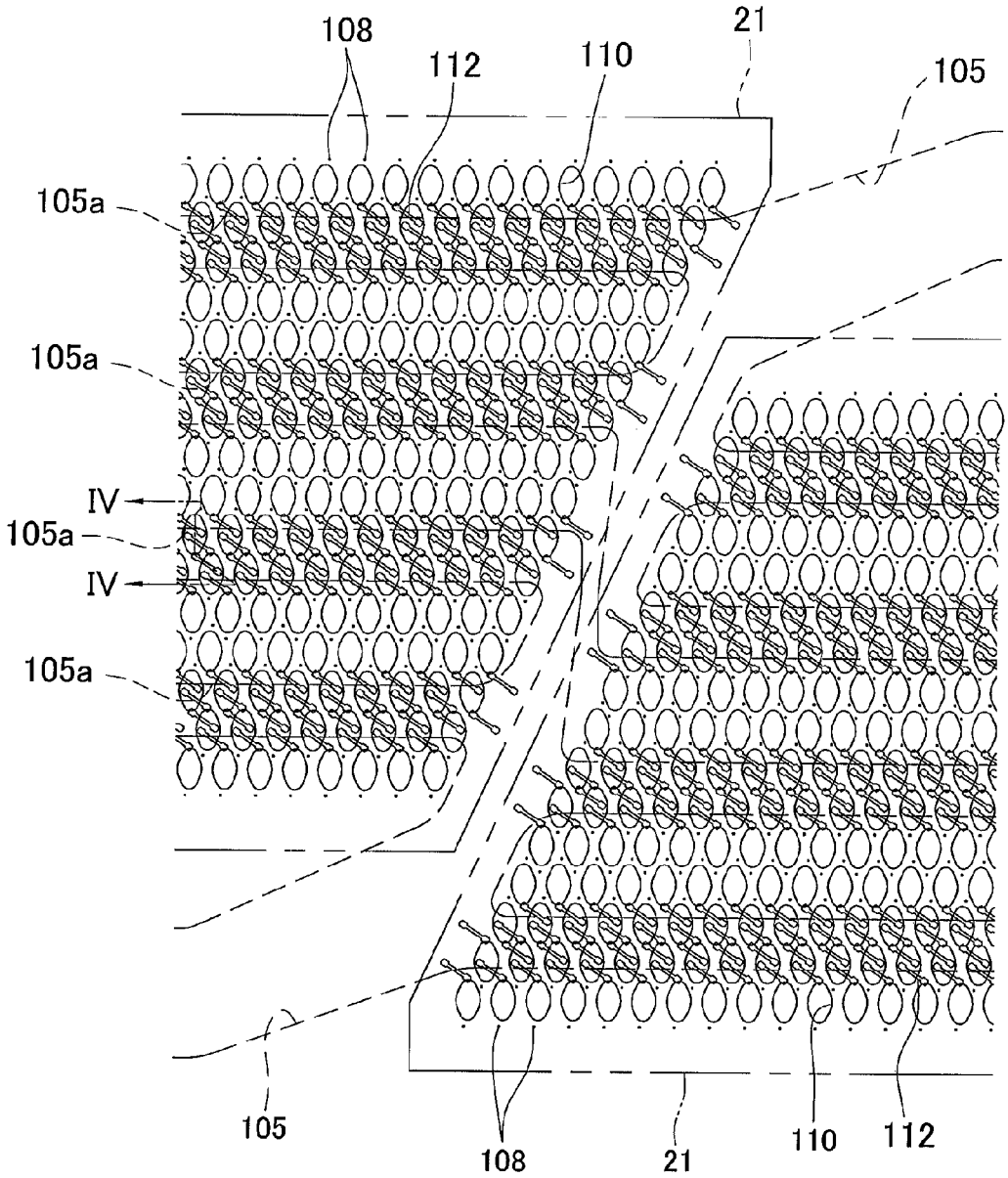
FIG. 3 is an enlarged view of an area surrounded by a dotted line shown in FIG. 2.

Next, the following details the head main body 1*a* with reference to FIG. 2 to FIG. 5. For the sake of convenience, FIG. 3 illustrates, in solid lines, pressure chambers 110, apertures 112, and ejection openings 108 which are under actuator units 21 and which should be illustrated in broken lines.

The head main body 1*a* is a layered body on which four actuator units 21 are fixed on the top surface of the passage unit 9 as shown in FIG. 2. Each of the actuator units 21 has a plurality of unimorph actuators corresponding to the pressure chambers 110, respectively, and selectively applies ejection energy to the ink inside the pressure chambers 110. Each of the heads 1 has a reservoir unit for storing ink to be supplied to the passage unit 9, a Flexible Printed Circuit (FPC) which supplies a drive signal to the actuator unit 21, and a control substrate which controls a driver IC 40 mounted on the FPC.

Figure 4:
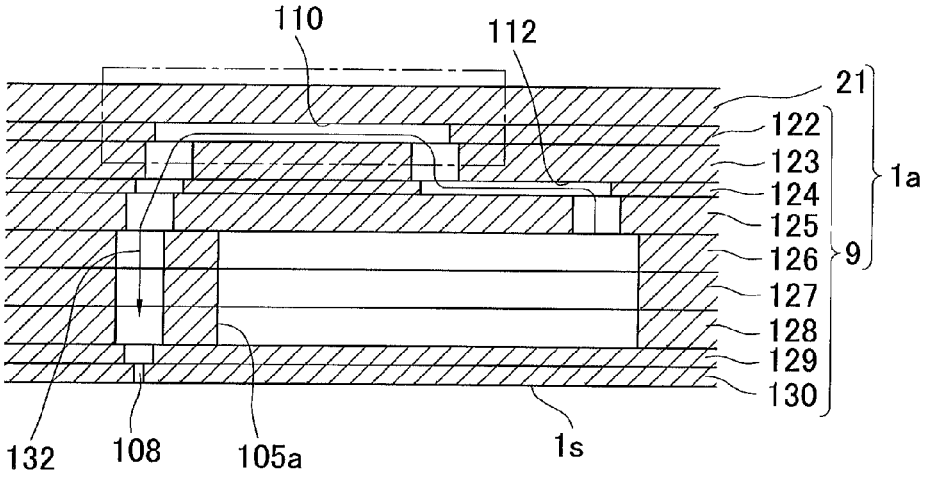
FIG. 4 is a partial cross sectional view taken along a line IV-IV shown in FIG. 3.

As shown in FIG. 4, the passage unit 9 is a layered body in which nine stainless-made metal plates 122 to 130 are stacked. On the top surface of the passage unit 9 are opened ten ink supply openings 105*b* as shown in FIG. 2 which communicate to the reservoir unit. Inside the passage unit 9 are formed manifold channels 105 each having the ink supply opening 105*b* at one end and a plurality of sub manifold channels 105*a* branching from the manifold channels 105, as shown in FIG. 2 to FIG. 4. Further, inside the passage unit 9 are formed a plurality of individual ink passages 132, each extending from an outlet of any one of the sub manifold channels 105*a* to an ejection opening 108 via a pressure chamber 110. On the ejection face is are formed a number of ejection openings 108. These ejection openings 108 are arranged at 600 dpi intervals relative to the main scanning direction and are arranged in a matrix as a whole.

The following describes a flow of ink in the passage unit 9, with reference to FIG. 2 to FIG. 4. The ink is supplied from the reservoir unit to each of the ink supply openings 105*b*. This ink flows into the manifold channels 105, more specifically, into the sub manifold channels 105*a*. The ink inside each of the sub manifold channels 105*a* is distributed to the individual ink passages 132, and reaches the ejection openings 108 via the apertures 112 and the pressure chambers 110.

Next, the following describes an actuator unit 21. As shown in FIG. 2, the four actuator units 21 are aligned in the main scanning direction in a zigzag manner while avoiding the ink supply openings 105*b*. Each of the actuator units 21 has a plane in a trapezoidal shape. Two sides of the actuator unit 21 parallel to each other extend in the main scanning direction. An oblique side of an actuator unit 21 is overlapped with that of an adjacent actuator unit 21 relative to the sub scanning direction of the passage unit 9. To the actuator unit 21, a drive signal is supplied from the driver IC 40 under control of the control unit 150, as is described hereinbelow.

Figure 5:
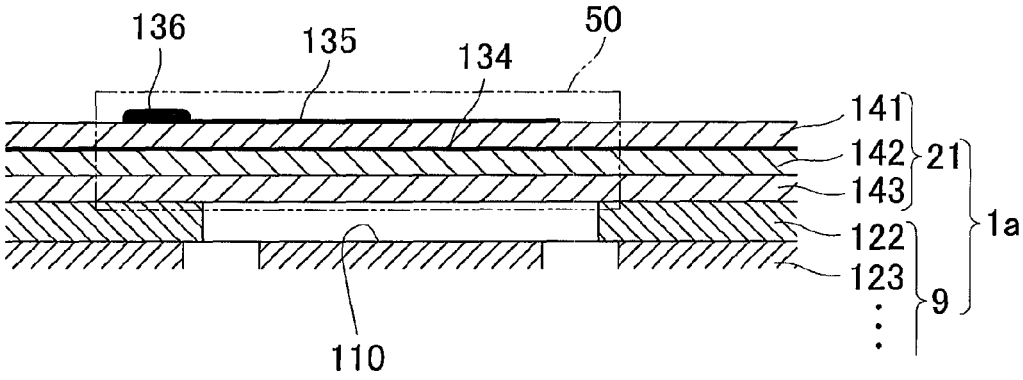
FIG. 5 is an enlarged view of an area surrounded by a dotted line in FIG. 4.

As shown in FIG. 5, each actuator unit 21 is a piezoelectric actuator which is structured by a three piezoelectric layers 141 to 143. The piezoelectric layers 141 to 143 are made of a lead zirconate titanate (PZT) based ceramic having ferroelectricity. The piezoelectric layer 141 at the uppermost layer is polarized in the thickness directions. Further, on the top surface of the piezoelectric layer 141 are formed a plurality of individual electrodes 135. Each of the individual electrodes 135 faces a pressure chamber 110. At the leading end of each individual electrode 135 is provided an individual land 136. Between the piezoelectric layer 141 and the piezoelectric layer 142 below is interposed a common electrode 134. The common electrode 134 is formed throughout the entire surface of the sheet. To the common electrode 134, the ground potential is applied. On the other hand, to the individual electrodes 135, a drive signal is selectively supplied via the individual lands 136.

When the potential of an individual electrode 135 is made different from that of the common electrode 134, a portion sandwiched by that individual electrode 135 and the pressure chamber 110 is deformed relative to the pressure chamber 110. This portion corresponding to the individual electrode 135 serves as an individual actuator 50 (see FIG. 5). In other words, the actuator unit 21 has a plurality of actuators 50 built therein in number corresponding to the number of corresponding pressure chambers 110.

The following describes a method of driving the actuator unit 21. One layer of the actuator unit 21 far from the pressure chamber 110, i.e., the piezoelectric layer 141, is a layer including an active portion. Two layers of the actuator unit 21 close to the pressure chamber 110, i.e., the piezoelectric layers 142 and 143, are inactive portions. In other words, the actuator unit 21 is a unimorph type actuator. The active portion is a portion sandwiched by the common electrode 134 and the individual electrode 135. For example, when the direction of polarization and the direction of applying an electric field are the same, the active portion constricts in in-plane directions orthogonal to the direction of polarization. At this time, there will be a difference in the distortion in the in-plane directions between the active portion and the piezoelectric layers 142 and 143 below. Due to this, the entire piezoelectric layers 141 to 143 deforms into a convex towards the pressure chamber 110 (unimorph deformation). This way, the pressure (ejection energy) is applied to the ink inside the pressure chamber 110, and an ink droplet is ejected from the ejection opening 108.

Each actuator 50 is driven by a drive signal supplied to the individual electrode 135. There are two types of drive signals: an "ejection drive signal" and a "non-ejection drive signal". When the ejection drive signal is supplied, the actuator 50 causes a change in the volume of the pressure chamber 110 to eject an ink droplet from the ejection opening 108. When the non-ejection drive signal is supplied, the actuator 50 changes the volume of the pressure chamber 110, but no ink droplet is ejected from the ejection opening 108. Instead, oscillation of a meniscus at the ejection opening 108 is induced. The former drive is hereinafter referred to as "ejection drive", and the latter drive as "non-ejection drive".

Figure 6:
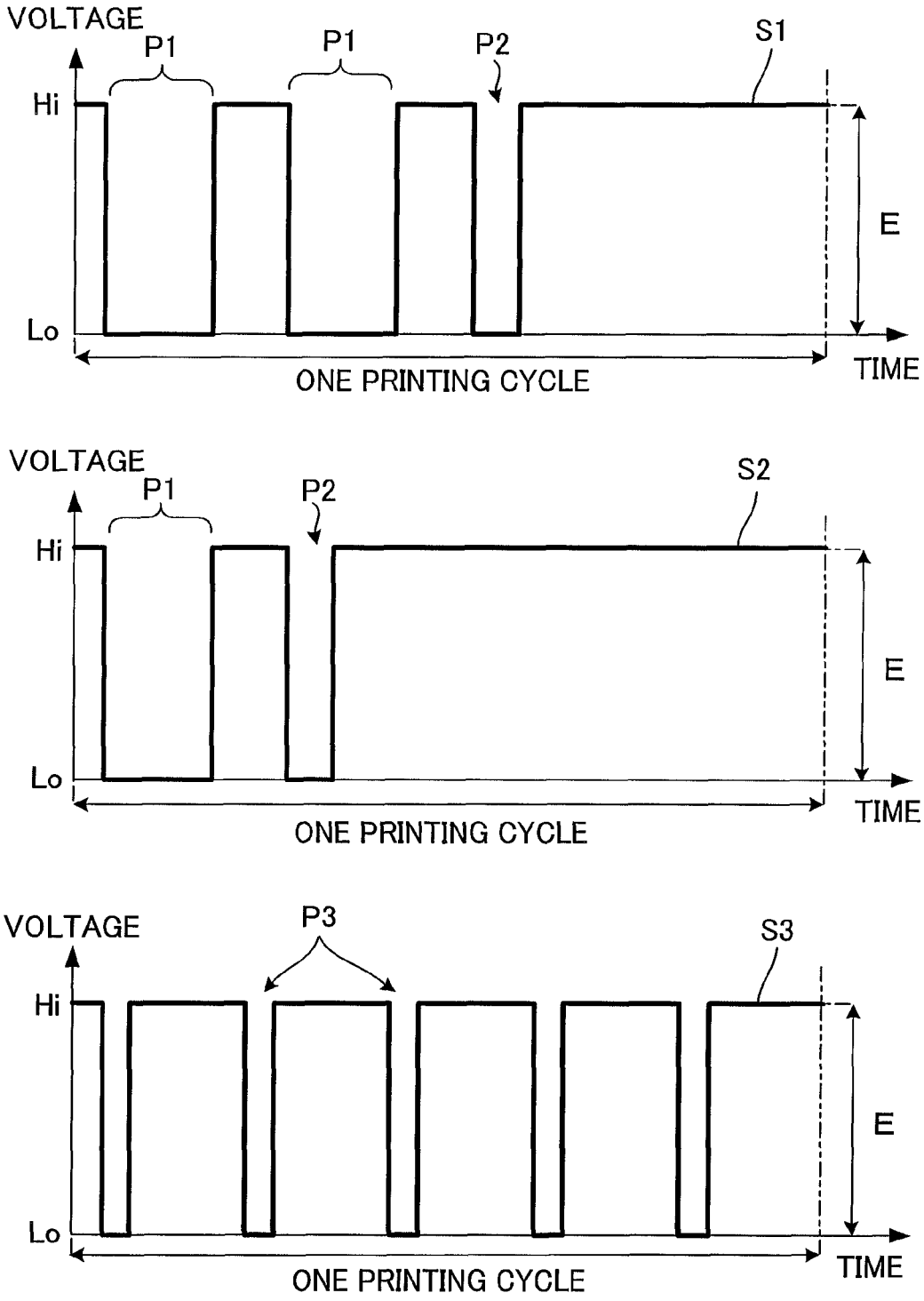
FIG. 6 is a diagram showing a waveform of a voltage pulse signal to be supplied to an actuator shown in FIG. 5.
Figure 7:
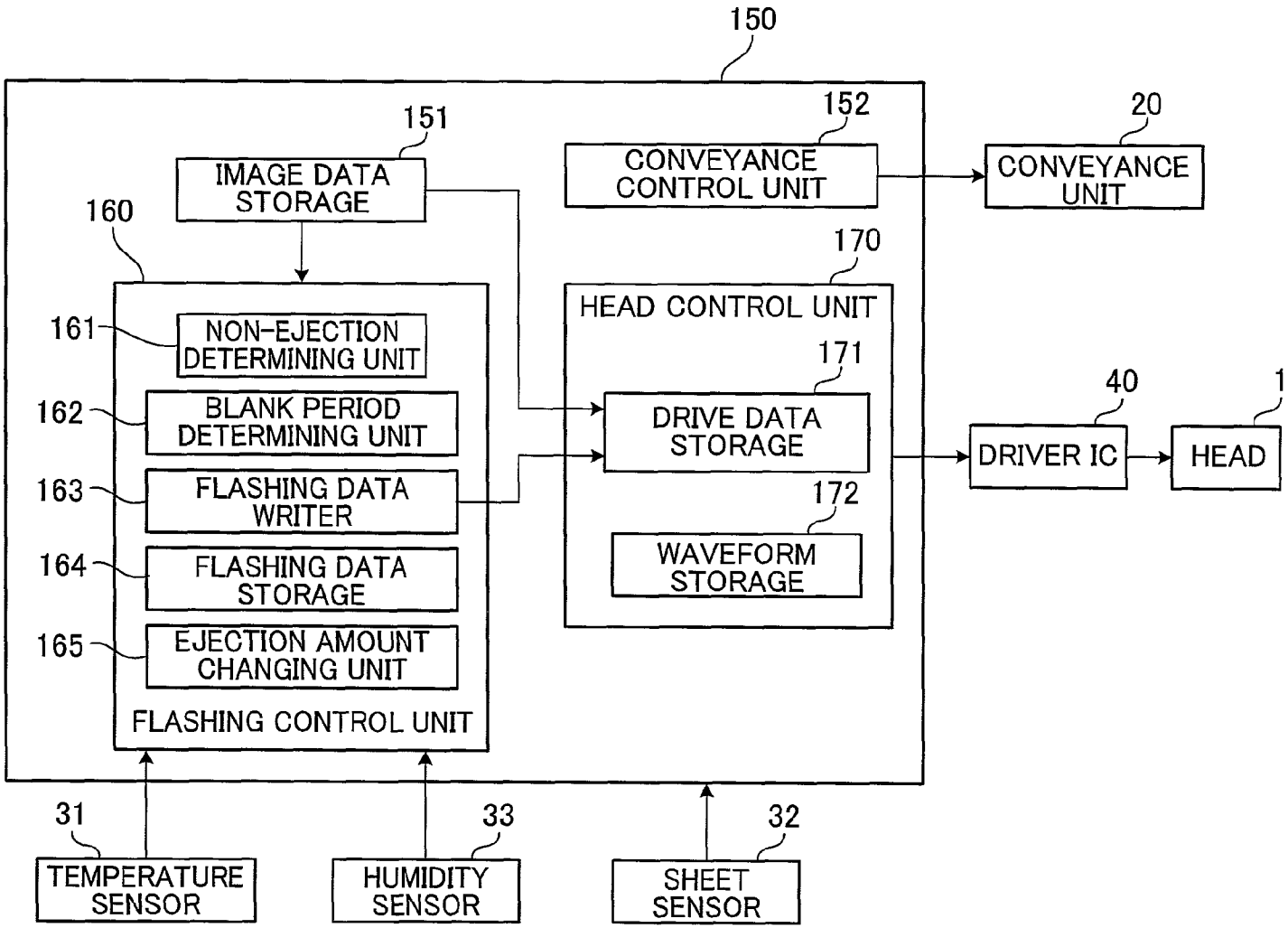
FIG. 7 is a functional block diagram of a control unit shown in FIG. 1.

Signals S1 and S2 in FIG. 6 are examples of the ejection drive signal. The signal S3 in FIG. 6 is an example of the non-ejection drive signal. Each of the signals S1 to S3 has a time length corresponding to one printing cycle. One printing cycle is a period of time taken for the conveyance unit 20 to convey a sheet P by a unit distance corresponding to a recording resolution, relative to the sub scanning direction. This unit distance is, specifically, a minimum interval between dots structuring an image, and a minimum arrangement pitch of dots on the sheet P relative to the sub scanning direction.

The signal S1 includes two consecutive pulses P1, followed immediately after by a single pulse P2. The pulses P1 and P2 are all square pulses generated by varying the potential of the individual electrode 135 between E(>0) (Hi) and the ground potential (Lo), as shown in FIG. 6. The voltage and the width of the pulse P1 are adjusted so that the actuator 50 is driven to eject an ink droplet. For example, the pulse width is approximately ½ of a proper oscillation cycle of the ink in the individual ink passage 132. At this time, the widths of the pulses P1 do not necessarily have to be the same. The width of pulse P2 and the interval between the pulse P1 immediately before the pulse P2 and the pulse P2 are adjusted so that residual oscillation induced by the pulses P1 is cancelled. The signal S2 includes a single pulse P1, followed immediately after by a single pulse P2. The signal S3 includes five consecutive pulses P3 at predetermined even intervals. The pulses P3 are square pulses generated by varying the potential of the individual electrode 135 between E and the ground potential. The pulse width of each of the pulses P3 is adjusted to a width narrower than the width of the pulse P2. Thus, the ink is not ejected.

When the signals S1 and S2 are supplied to the individual electrode 135, the ink is ejected from the ejection opening 108 as follows. Namely, for a single pulse P1, one ejection is performed. In the present embodiment, the individual electrode 135 is maintained at the potential E(>0) in advance. Therefore, the piezoelectric layers 141 to 143 are kept in a unimorph-deformed state. The volume of the pressure chamber 110 at this time is V1. When the signal S1 or S2 is supplied to the individual electrode 135, the potential of the individual electrode 135 starts to drop from E to the ground potential, at the leading end of the pulse P1. When the potential of the individual electrode 135 reaches the ground potential, the piezoelectric layers 141 to 143 return to the state before the deformation. Therefore, the volume of the pressure chamber 110 increases from V1 to V2 (>V1). This increase in the volume causes a negative pressure to the ink inside the pressure chamber 110, and ink is sucked into the individual ink passage 132 from the sub manifold channel 105*a*.

At the trailing end of the pulse P1, the potential of the individual electrode 135 starts to return to E. When the potential of the individual electrode 35 returns to E, the piezoelectric layers 141 to 143 once again returns to the unimorph-deformed state, and the volume of the pressure chamber 110 also returns to V1. This decrease in the volume causes positive pressure to the ink inside the pressure chamber 110, thus ejecting ink from the ejection opening 108. With the signal S1, such an eject operation is performed twice, and the ink therefore is ejected twice. With the signal S2, the eject operation is performed once and the ink is ejected once. After a predetermined interval, the residual oscillation of the ink is cancelled by the pulse P2. This way, even if the eject operation is performed in the printing cycle, the subsequent driving is hardly affected.

The signal S1 causes more ejection than the signal S2. As such, under conditions where the ejection characteristics of the ejection opening 108 are the same, the ink is ejected more with the signal S1 than the signal S2. Therefore, the signal S1 causes formation of a larger dot on the sheet P than the signal S2. The larger dot is hereinafter referred to as a large dot and the dot formed by the signal S2 is hereinafter referred to as a small dot.

When the pulse P3 in the signal S3 is supplied to the individual electrode 135, the actuator 50 deforms and changes the volume of the pressure chamber 110 as is the case of pulse P1. When the leading end of the pulse is supplied, discharging of an electric charge takes place between the electrodes in the active portion. When the trailing end of the pulse is supplied, charging of an electric charge takes place between the electrodes in the active portion. The charging and discharging are transient phenomenon. Each phenomenon takes a predetermined amount of time from the start to its completion. On the other hand, the width of the pulse S3 is smaller than the sum of the predetermined amount of times. Therefore, in the actuator 50, charging starts before the deformation by discharging is completed. The actuator 50 therefore returns to the original state before the deformation is completed. Thus, the amount of change in the volume of the pressure chamber 110 by the pulse P3 is small as compared with the case of the pulse S1. As a result, no ink is ejected from the ejection opening 108. In other words, when the signal S3 is supplied, the volume of the pressure chamber 110, in response to the pulse P3, changes from the V1 to V2' (where: V2'<V2) and then returns to V1. Such a pulse P3 is supplied five times in a row within one printing cycle. This causes micro oscillation of the ink nearby the ejection opening 108, thus restraining an increase in the viscosity of the ink.

The following describes a structure of the control unit 150 and a method of controlling the each part. The control unit 150 includes: an image data storage 151, a conveyance control unit 152, a flashing control unit 160, and a head control unit 170. The image data storage 151 stores an image data set based on which image formation is performed. This image data set is received from an external apparatus via a cable or the like, or read out from various recording medium. After that, the image data set is stored in the image data storage 151. The conveyance control unit 152 controls the conveyance unit 20 so as to convey the sheet P at a predetermined speed.

The head control unit 170 has a drive data storage 171 and a waveform storage 172. The drive data storage 171 stores drive data. The drive data indicates a drive signal to be supplied to the actuator 50 and the timing of supplying the signal. The waveform storage 172 stores waveform signals corresponding to the waveforms of signals S1 to S3 shown in FIG. 6. The head control unit 170 generates the drive data based on the image data set having been transmitted from the image data storage 151, and stores the drive data in the drive data storage 171. The drive data generated by the head control unit 170 alone only contains a data set indicative of the ejection drive signal. In other words, the head control unit 170 of the present embodiment alone only generates drive data instructing which one of the signals S1 and S2 is to be supplied. This drive data is hereinafter referred to as an ejection drive data. On the other hand, as hereinbelow described, when flashing data which is generated by the flashing control unit 160 is written into the drive data storage 171, the drive data becomes data containing instruction of supplying the signal S3 which is the non-ejection drive signal. This drive data is hereinafter referred to as non-ejection drive data.

The head control unit 170 outputs the drive data stored in the drive data storage 171 and the waveform signal stored in the waveform storage 172 to the driver IC 40, successively. Thus, the head control unit 170 causes the driver IC 40 to supply signals S1 and S2 to the actuator 50. The timing of outputting the drive data and the waveform signal by the head control unit 170 is synchronized with the timing of the conveyance control unit 152 conveying the sheet P, based on a detection signal from the sheet sensor 32.

The driver IC 40 supplies at each printing cycle any one of the signals S1 to S3 to each actuator 50 of the head 1, based on the drive data and the waveform signal from the head control unit 170. This causes ejection of ink from the ejection face 1*s*, thus forming a color image on the sheet P. The ink nearby the ejection opening 108 is subjected to micro oscillation for the purpose of solving the problem of an increase in the viscosity of ink.

The flashing control unit 160 has a non-ejection determining unit 161, a blank period determining unit 162, a flashing data writer 163, a flashing data storage 164, and an ejection amount changing unit 165. The non-ejection determining unit 161 refers to the image data, and counts the number of continuous printing cycles in which no ink ejection takes place. The number of continuous printing cycles corresponds to the non-ejection period during which no ink ejection takes place. Further, the non-ejection determining unit 161 determines whether the non-ejection period is equal to or longer than a predetermined length T. This process of deriving the non-ejection period, and comparison of the non-ejection period with the threshold T are performed for each of the ejection openings 108. As described, the non-ejection period is a period between a point where one ejection drive is performed and a point of performing the subsequent ejection drive. In the present embodiment, the value of T is a fixed value. During the non-ejection period, the moisture of the ink nearby the ejection opening 108 is evaporated. This increases the viscosity of the ink. Performing meniscus oscillation immediately before ejection drive is effective for stable ejection during the ejection drive. Therefore, the flashing control unit 160 sets, as the non-ejection drive period, a period corresponding to the trailing end portion of the non-ejection period, which is immediately before the subsequent ejection drive (see FIG. 9). The non-ejection drive within this period solves the problem of an increase in the viscosity of the ink immediately before the ejection drive.

However, the non-ejection drive generates residual oscillation within the ink. The residual oscillation may affect the ejection characteristics of the ink, in the subsequent ejection drive. Therefore, the flashing control unit 160 sets a blank period immediately before the ejection drive. During the blank period, neither ejection drive nor non-ejection drive is performed. As described, the non-ejection drive period includes a first half part and a second half part. The first half part is a period during which non-ejection drive is performed, and the second half part is the blank period. This ensures a time for attenuating the oscillation, thereby enabling retraining of an influence of the non-ejection drive to the ejection drive.

The time needed for sufficiently restraining the influence of the oscillation varies depending on the environmental conditions such as the temperature and the humidity. A change in the environmental conditions causes a change in the characteristics of the ink, and a change in the thickening speed. Therefore, the blank period determining unit 162 sets the length of the blank period based on results of measurement given by the temperature sensor 31 and the humidity sensor 33 (see FIG. 9). The length of the blank period is adjusted based on at least one of the temperature and the humidity. For example, the speed of increasing the ink viscosity drops with a decrease in the temperature and an increase in the humidity. Therefore, there only needs a short period of time for performing the non-ejection drive to solve the problem of an increase in the viscosity of ink. As long as the non-ejection drive period is constant, the blank period may be long. Therefore, the blank period determining unit 162 sets a long blank period, when the temperature is low or when the humidity is high. On the other hand, the speed of increasing the ink viscosity accelerates with an increase in the temperature and a decrease in the humidity. Therefore, the operation for solving the problem of an increase in the viscosity of ink needs to be performed for a long time. When the temperature is high or when the humidity is low, the blank period determining unit 162 sets a shot blank period. Further, when the temperature rises above a threshold or when the humidity drops lower than a threshold, the operation for solving the problem of an increase in the viscosity of ink needs to be performed for even a longer time. In this case, the blank period determining unit 162 omits the blank period.

Reflecting the length of the blank period determined by the blank period determining unit 162, the flashing control unit 160 generates flashing data. The flashing data is data instructing an operation during the non-ejection drive period. Specifically, the flashing data is structured by blank data corresponding to the blank period and non-ejection drive data. The blank data instructs supplying of no ejection drive signal and no non-ejection drive signal during the blank period within the non-ejection drive period. The non-ejection drive data instructs supplying of the non-ejection drive signal during a period other than the blank period. The flashing data generated is stored in the flashing data storage 164. For each of the ejection openings 108, the flashing data storage 164 stores the flashing data.

Figure 9:
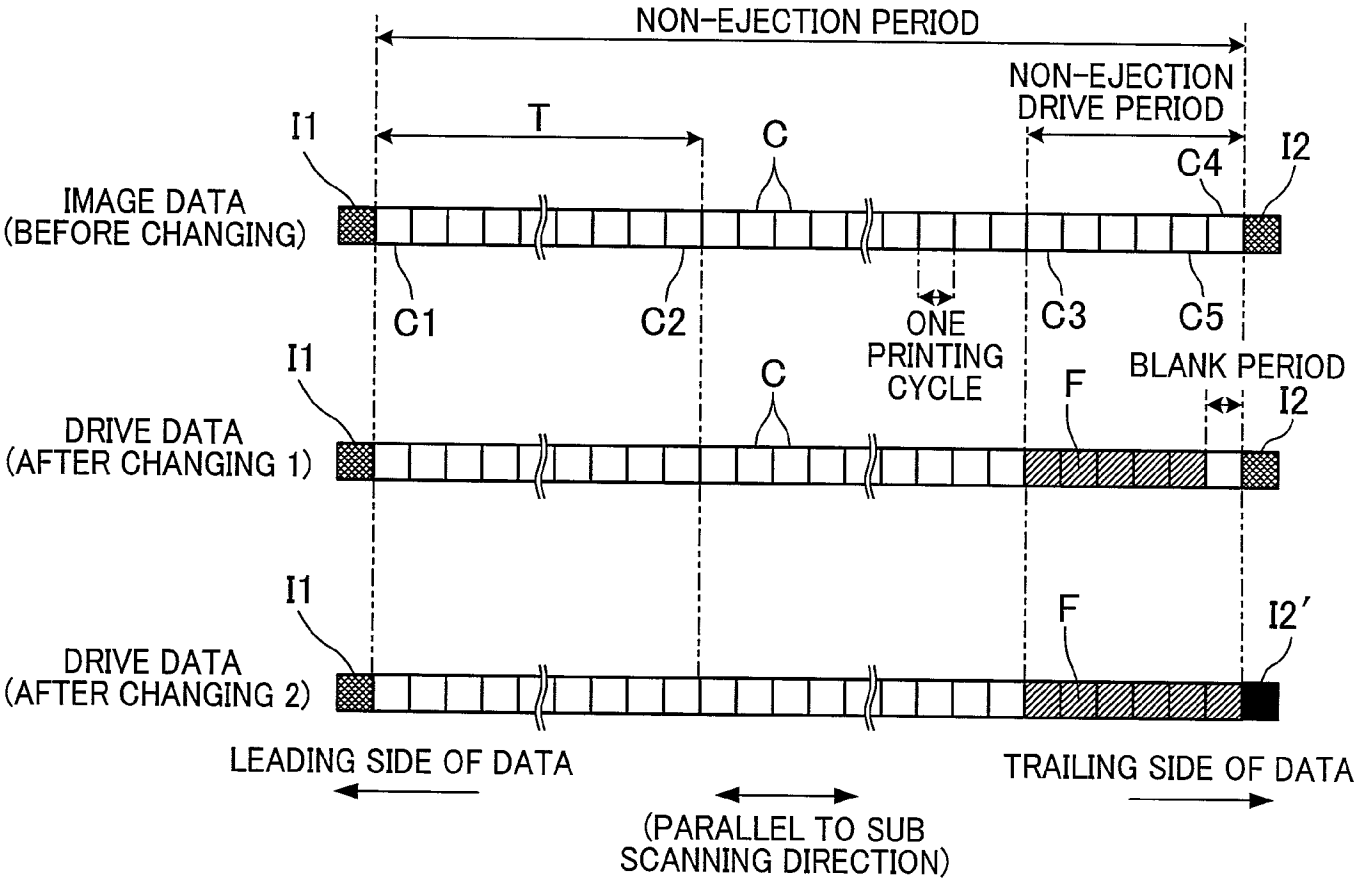
FIG. 9 is a conceptual diagram showing image data before a change by the flashing control unit and drive data after a change by the flashing control unit.
Figure 10A:
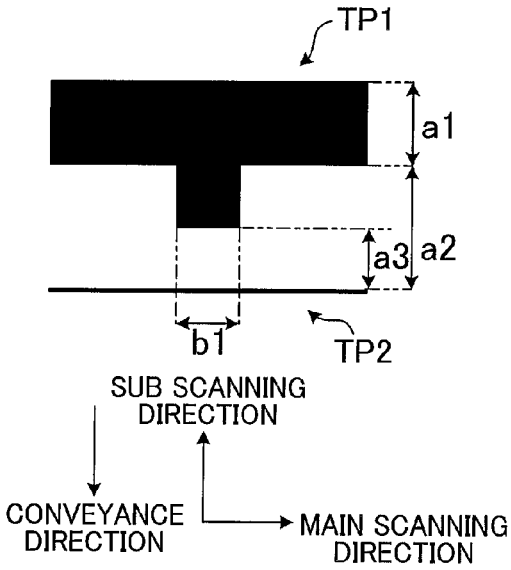
FIG. 10A shows a test pattern used in examples related to the present embodiment.
Figure 10B:
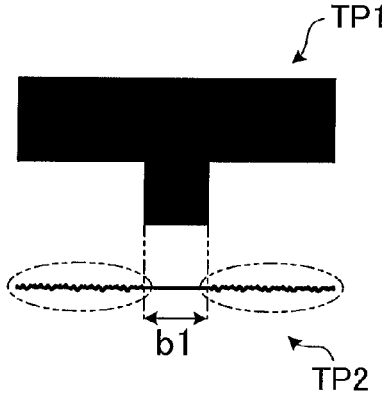
FIG. 10B shows a result of an example.
Figure 10C:
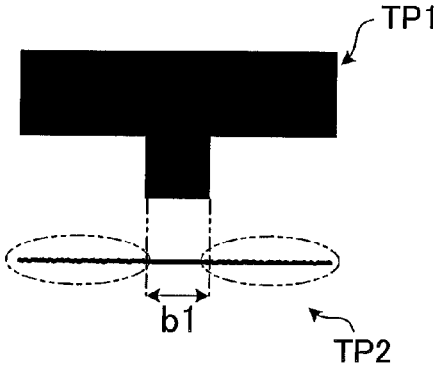
FIG. 10C shows a result of an example.
Figure 10D:
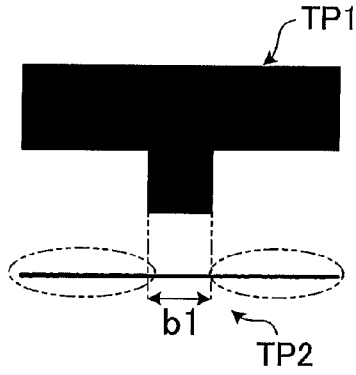
FIG. 10D shows a result of an example.

The flashing data writer 163 writes the flashing data stored in the flashing data storage 164 into the drive data storage 171 of the head control unit 170. Of the drive data based on the image data, a range of data corresponding to the non-ejection period is blank data, as shown in FIG. 9 for example. The flashing data writer 163 writes the flashing data over this blank data corresponding to the non-ejection drive period. After this, the head control unit 170 outputs the drive data to the driver IC 40. The driver IC 40 supplies the non-ejection drive signal to the actuator 50, at a timing corresponding to the flashing data.

The ejection amount changing unit 165 updates an amount of ink to be ejected, immediately after the non-ejection drive period, in cases of predetermined environmental conditions. For example, when the temperature is extremely high or extremely low, the viscosity of ink easily increases. In this case, the problem of an increase in the viscosity of ink may not be sufficiently solved even if the non-ejection drive is performed throughout the entire non-ejection drive period. For this reason, a desirable amount of ink to be ejected may not be ensured when the ejection drive is performed immediately after the non-ejection drive period. To address this issue, if there is ejection drive data indicating ejection of a larger amount of ink than the amount of ink to be ejected by the current ejection drive data, the flashing control unit 160 changes the current ejection drive data to that ejection drive data indicating ejection of a larger amount of ink.

Specifically, when the temperature is equal to or higher than a predetermined upper limit value, or when the humidity is equal to or lower than a predetermined lower limit value, the ejection amount changing unit 165 refers to a data unit in the image data stored in the image data storage 151, which unit corresponds to a point immediately after the non-ejection drive period. When the data unit in the image data is a data unit instructing formation of a small dot, the corresponding ejection drive data in the drive data storage 171 is changed to data instructing formation of a large dot. Thus, the signal to be supplied by the driver IC 40 based on the drive data is changed from a signal S2 to a signal S1. On the other hand, when the data unit instructs formation of a large dot, the ejection drive data will not be changed.

Under an environment which further facilitates thickening of ink, the ejection amount changing unit 165 may change the final set of data corresponding to the non-ejection drive period to data instructing formation of a dot. In this case, it is preferable to change the data to data instructing formation of a small dot. This enables reliable ink ejection in the eject operation immediately after the non-ejection drive period.

Figure 8:
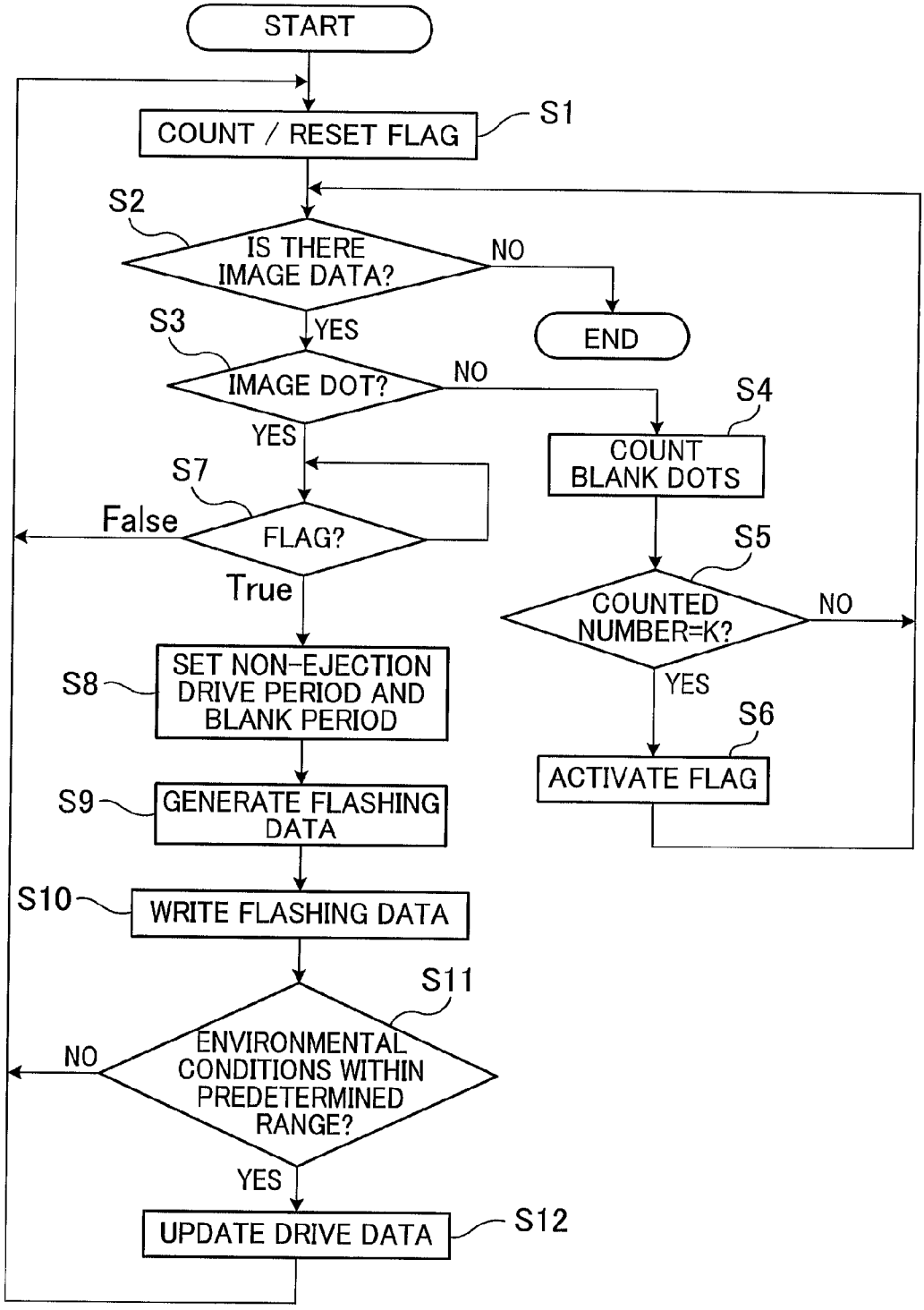
FIG. 8 is a flowchart showing a process executed by a flashing control unit shown in FIG. 7.

The following describes a specific flow of a process executed by the flashing control unit 160, with reference to FIG. 8. The process described below is a process relating to a single ejection opening 108. The same process is executed for all of the ejection openings 108. The data to be processed is image data corresponding to all the pixels aligned in the sub scanning direction, relative to the process-related ejection opening 108.

First, the non-ejection determining unit 161 resets the count and a non-ejection drive flag for determination use (S1). Next, the non-ejection determining unit 161 determines if the image data corresponding to an image to be formed in the image data storage 151 (S2). If it is determined that there is no image data left (S2, No), a series of processes is ended.

When the non-ejection determining unit 161 determines that there is image data (S2, Yes), the non-ejection determining unit 161 makes reference to data units of the image data in the image data storage 151 sequentially in units of dot, i.e., in units of printing cycle, and determines whether each data unit corresponds to a printing cycle which ejects ink to form a dot (hereinafter, dot formation cycle) (S3). When the data unit does not correspond to the printing cycle for forming a dot; i.e., when the data unit corresponds to a printing cycle which ejects no ink (hereinafter, a blank cycle) (S3, No), the non-ejection determining unit 161 counts the blank cycles, while sequentially referring to data units in the image data (S4). Then, the non-ejection determining unit 161 determines whether the counted number has reached k (where k=a natural number of 2 or more) (S5: see FIG. 9). The counted number k is set to a number which corresponds to the predetermined length T. When it is determined that the counted number has not yet reached k (S5, No), the process returns to S2. When the non-ejection determining unit 161 determines that the counted number has reached k (S5, Yes), the non-ejection determining unit 161 activates the non-ejection drive flag indicating that non-ejection drive should be executed (S6). The process then returns to S2.

When it is determined in S3 that the data unit corresponds to a dot formation cycle (S3, Yes), the flashing control unit 160 determines whether or not the non-ejection drive flag is active (S7). When the non-ejection drive flag is inactive (S7, False), the flashing control unit 160 returns to S1. When the non-ejection drive flag is active (S7, True), the flashing control unit 160 sets the non-ejection drive period, and the blank period determining unit 162 sets the blank period (S8). The length of the non-ejection drive period is fixed to n printing cycle(s) (where n is a natural number of 2 or higher which satisfies n<k). The length of the blank period is set between zero to m printing cycle(s) (where m is a non-negative integer which satisfies m<n). The blank period is increased/decreased in units of one printing cycle based on the environmental conditions. Next, the flashing control unit 160 generates flashing data (S9), and the flashing data writer 163 writes the flashing data into drive data storage 171 (S10). Next, the ejection amount changing unit 165 determines whether the environmental conditions are within a predetermined range (S11). When it is determined that the environmental conditions are not within the predetermined range (S11, No), the process returns to S1. When it is determined that the environmental conditions are within the predetermined range (S11, Yes), the ejection amount changing unit 165 updates the drive data immediately after the non-ejection drive period (S12). In this case, the flashing control unit 160 sets the blank period to zero in S8. When it is determined that the environmental conditions are within another predetermined range in which thickening of ink is facilitated, the ejection amount changing unit 165 may change the last flashing data of the non-ejection drive period to the drive data, in addition to the process of S12. At this time, the drive data having been changed from the flash data may be data instructing formation of a small dot. The process then returns to S1.

The following describes an application of the above described flow of the process to image data of FIG. 9. In the image data of FIG. 9, the non-ejection period corresponds to a period from ejection drive data I1 to ejection drive data I2, in which sets of blank data C are continued. In the present example, the ejection drive data I1 and I2 both correspond to a small dot. In other words, the ejection drive data I1 and I2 correspond to a dot formed by the signal S2. The non-ejection determining unit 161 starts counting from blank data C1 which is subsequent to the ejection drive data I1 (S4), and activates the non-ejection drive flag at blank data C2 where the counted number reaches k (S5, Yes→S6). When the non-ejection determining unit 161 refers to the ejection drive data I2 (S3, Yes), the non-ejection period is determined as to be a period from the blank data C1 to the blank data C4.

Based on the non-ejection drive flag in the active state, the flashing control unit 160 sets the non-ejection drive period at the posterior end portion of the non-ejection period (S7, True→S8). Next, the blank period determining unit 162 sets a blank period based on the measurement results of the temperature and the humidity (S8). The flashing control unit 160 generates flashing data containing non-ejection drive data F in a period other than the blank period within the non-ejection drive period (S9), and the flashing data writer 164 transfers the data to the drive data storage 171 (S10).

In the present embodiment, the length of the non-ejection drive period is fixed to 6 dots, i.e., 6 printing cycles, as shown in FIG. 9. Therefore, the length of the blank period is adjusted in units of 1 dot, i.e., in units of one printing cycle, within the range of 0 dot to 6 dots. FIG. 9 shows a case where the length of the blank period is set to 1 dot. Further, the flashing data contains the non-ejection drive data F in all the printing cycles in the period other than the blank period within the non-ejection drive period.

When the environmental conditions are within the predetermined range, the ejection amount changing unit 165 changes the drive data immediately after the non-ejection drive period, from data corresponding to the ejection drive data I2 to data corresponding to the ejection drive data I2'. The ejection drive data I2' corresponds to a large dot. In other words, the ejection drive data set I2' corresponds to a dot formed by the signal S1. Further, as mentioned hereinabove, with the change of the ejection drive data I2 to the drive data I2', the blank period is omitted. Further, when the environmental conditions facilitate thickening of ink, the ejection drive data I1 may be allotted to the last printing cycle in the non-ejection drive period, in addition to the change of the ejection drive data I2.

The following describes examples of the present embodiment with reference to FIG. 10. In the Example, an image was formed on a sheet P based on test patterns TP1 and TP2 shown in FIG. 10(*a*). FIG. 10(*b*) to FIG. 10(*d*) show the results. The test patterns are formed under the same temperature and the same humidity.

The test pattern TP1 is structured by: a rectangular solid image whose width in the sub scanning direction is a1, and which extends in the main scanning direction; and a rectangular solid image projecting in the direction opposite to the sub scanning direction in the area b1 relative to the main scanning direction. The test pattern TP2 is a straight line parallel to the main scanning direction, and is disposed downstream of TP1 by a predetermined distance, in the conveyance direction. Further, the distance a2 between TP1 and TP2 relative to the sub scanning direction in areas other than the area b1 is at least a distance corresponding to the predetermined length T which is the condition for activating the non-ejection drive flag. The distance a3 between TP1 and TP2 relative to the sub scanning direction in area b1 is less than a distance corresponding to the predetermined length T. Thus, in application of the above described embodiment, the non-ejection drive period is not set immediately before formation of TP2 in area b1, but is set immediately before formation of TP2 in areas other than the area b1, and the non-ejection drive is performed in these areas.

In FIG. 10(*b*) to FIG. 10(*d*), the images were formed while changing the blank period, irrespective of the environmental conditions. First, in FIG. 10(*b*), a relatively long blank period of 3 printing cycles was set. As the result, there was distortion in alignment of dots of TP2 in the areas other than the area b1 (the areas surrounded by double-dashed lines). This is because in areas other than the area b1, the non-ejection drive was not sufficient, and the problem of an increase in the viscosity of ink was not sufficiently solved. As the result, the ink ejection by the ejection drive for forming TP2 immediately after the non-ejection drive period was unstable. On the other hand, not much disorder has resulted in the area b1. This is because, the distance between TP1 and TP2 is short, and the length of period elapsed from formation of TP1 to formation of TP2 is less than the predetermined length T. Therefore, there was no significant increase in the viscosity of the ink. In FIG. 10(*c*), the blank period was omitted. This resulted in less distortion in the alignment of dots in the areas of TP2 other than b1, i.e., the area surrounded by the double-dashed line, as compared with FIG. 10(*b*). The minor distortion however is due to the residual oscillation from the non-ejection drive, which caused irregular ejection characteristics in formation of TP2. Further, in FIG. 10(*d*), the blank period is set to one printing cycle. This resulted in even less distortion of dot alignment in the areas of TP2 other than b1, i.e., the areas surrounded by the double-dashed line, as compared with FIG. 10(*c*). The influence from the non-ejection drive was almost none.

The above examples show that (1) executing non-ejection drive before ejection drive is effective when executing the ejection drive after a certain period of time from the previous ejection drive; (2) setting a blank period between the non-ejection drive and the subsequent ejection drive is effective in restraining the influence of the non-ejection drive to the subsequent ejection drive; and (3), to achieve sufficient effect, the blank period needs to be adjusted to a length suitable for the environmental conditions.

In the present embodiment, a blank period is provided at the trailing end portion of the non-ejection drive period, and the length of the blank period is adjusted based on the environmental conditions, as shown in FIG. 9. Therefore, an influence from the non-ejection drive based on the non-ejection drive data F to the ejection drive based on the ejection drive data I2 is restrained suitably for the environmental conditions. Further, in the present embodiment, the non-ejection drive period is fixed. Therefore, the non-ejection drive data F is reduced with an increase in the length of the blank period based on the environmental conditions. Thus, it is possible to restrain the power consumption needed for supplying the non-ejection drive data F, while restraining the influence from the non-ejection drive to the ejection drive suitably for the environmental conditions.

The present invention is not limited to the embodiment described above, and the design thereof may be altered in many ways. The following describes exemplary alternative forms of the present embodiment.

The first alternative form is such that the non-ejection drive period is not fixed and is variable based on the length of the non-ejection period. In the present alternative form, the flashing control unit 160 sets the non-ejection drive period so that the non-ejection drive period increases with an increase in the proportion of the non-ejection period to the predetermined length T. For example, when the length of the non-ejection period is twice as long as T, the length of the non-ejection drive period is set to be twice the length of a case where the length of the non-ejection period is T. Alternatively, the present alternative form may be structured so that, with an increase in the ratio of the length of the non-ejection period to T, a predetermined number of printing cycles which increases at a predetermined rate may be added to the non-ejection drive period. The viscosity of ink is expected to be higher with an increase in the length of the non-ejection period. Therefore, the length of non-ejection drive period is extended with that increase. Thus, a suitable length of the non-ejection drive is executed, suitably recovering the ejection characteristics.

A second alternative form is such that the predetermined length T is variable. In the present alternative form, the flashing control unit 160 changes T based on the environmental conditions. For example, T is reduced with a decrease in the humidity. Doing so will increase the number of times the non-ejection drive flag is activated, and increases the frequency of the non-ejection drive. Since ink more easily thickened with low humidity, increasing the frequency of the non-ejection drive facilitates recovery of the ink ejection characteristics. With the present alternative form, the non-ejection drive is executed a suitable number of times for the environmental conditions.

The other possible alternative forms are, for example, as follows. In the above-described embodiment, the length of the blank period and the ejection amount of ink are adjusted based on at least one of the temperature and the humidity. The length of the blank period or the like may however be adjusted based on both of the temperature and the humidity. Further, when environmental conditions are such that thickening of ink hardly progress; e.g., the humidity is sufficiently high and the temperature is sufficiently low, the blank period determining unit 162 may set the length of the blank period to a length substantially equal to the length of the non-ejection drive period. In other words, the non-ejection drive may be omitted under certain environmental conditions.

Application of the present invention is not limited to a printer. The present invention is applicable to various liquid ejection apparatus such as facsimile, photocopier, and the like. The ink jet head is not limited to line ink-jet head, and may be a serial type. Further, the liquid to be ejected may be a liquid other than ink.

What is claimed is:

1. A liquid ejection apparatus, comprising:

a liquid ejection head including an ejection opening which ejects a liquid, a supply passage which supplies the liquid to the ejection opening, and an actuator which applies an energy to the liquid inside the supply passage;

a drive unit which selectively supplies an ejection drive signal and a non-ejection drive signal to the actuator, the ejection drive signal being a signal whereby the actuator is driven so as to eject the liquid from the ejection opening, the non-ejection drive signal being a signal whereby the actuator is driven to an extent that no liquid is ejected from the ejection opening;

a print controller which causes the drive unit to supply the ejection drive signal to the actuator based on image data;

a non-ejection drive controller which causes the drive unit to supply at least one non-ejection drive signal to the actuator within a non-ejection drive period which is a period at a trailing end portion of a non-ejection period between ejection of the liquid and the next ejection of the liquid from the ejection opening, when the non-ejection period is equal to or longer than a predetermined length, based on the image data; and an environment measurement unit which measures at least one of the temperature and the humidity, wherein the non-ejection drive controller controls the drive unit so that the length of a blank period is varied based on at least one of the temperature and the humidity measured by the environment measurement unit, the blank period being a period between a point of supplying a final non-ejection drive signal within the non-ejection drive period and the trailing end of the non-ejection period, so that the length of the blank period is set to be increased with one of a decrease in the temperature and an increase in the humidity and the length of the blank period is set to be decreased with one of an increase in the temperature and a decrease in the humidity.

2. The liquid ejection apparatus, according to claim 1, further comprising a conveyance unit disposed to face the ejection opening, which conveys a recording medium, wherein the non-ejection drive controller controls the drive unit so that, where one printing cycle is a period of time needed for the conveyance unit to convey the recording medium by a unit distance corresponding to the recording resolution of the conveyance direction, the length of the non-ejection drive period is n printing cycle (n=a natural number of 2 or greater), the length of the blank period is m printing cycle (m=a non-negative integer satisfying m<n), and a non-ejection drive signal is supplied to the actuator consecutively in each printing cycle, within a period from the leading end of the non-ejection drive period to the (n−m) th printing cycle.

3. The liquid ejection apparatus according to claim 2, wherein the non-ejection drive controller controls the drive unit so that the length of the blank period is varied in units of one printing cycle according to at least one of the temperature and the humidity measured by the environment measurement unit.

4. The liquid ejection apparatus according to claim 2, wherein the non-ejection drive controller, controls the drive unit so that the length of the blank period is zero printing cycle, when at least one of the temperature and the humidity measured by the environment measurement unit satisfies a predetermined condition.

5. The liquid ejection apparatus according to claim 1, wherein the length of the non-ejection drive period is fixed.

6. The liquid ejection apparatus according to claim 1, wherein the non-ejection drive controller has a non-ejection drive period setting unit which sets the length of the non-ejection drive period so that the length increases with an increase in the proportion of non-ejection period relative to the predetermined length.

7. The liquid ejection apparatus according to claim 1, wherein there are a plurality of types of signals as the ejection drive signal, which are set so that the amount of liquid to be ejected from the ejection opening while the ejection characteristics are the same is differentiated, the print controller includes a signal changing unit which changes the ejection drive signal to be supplied to the actuator by the drive unit immediately after the non-ejection period to another ejection drive signal which causes ejection of a larger amount of the liquid, based on at least one of the temperature and the humidity measured by the environment measurement unit.

8. The liquid ejection apparatus according to claim 1, wherein the predetermined length varies based on at least one of the temperature and the humidity measured by the environment measurement unit.

9. The liquid ejection apparatus according to claim 1, wherein the non-ejection drive controller has a data changing unit which changes a data unit in the image data which indicates that supplying of none of the ejection drive signal and the non-ejection drive signal, to a data unit indicating supplying of the non-ejection drive signal.

* * * * *